US006459073B1

(12) United States Patent
Berger

(10) Patent No.: US 6,459,073 B1
(45) Date of Patent: Oct. 1, 2002

(54) ARTS AND CRAFTS HOT POT

(75) Inventor: Barry Berger, New York, NY (US)

(73) Assignee: Ranger Industries, Inc., Tinton Falls, NJ (US)

( * ) Notice: Subject to any disclaimer, the term of this patent is extended or adjusted under 35 U.S.C. 154(b) by 0 days.

(21) Appl. No.: 09/812,257

(22) Filed: Mar. 19, 2001

(51) Int. Cl.[7] ..... B67D 5/63; F27B 14/14; F27B 14/18; F27B 14/06

(52) U.S. Cl. ..... 219/433; 219/432; 219/421; 219/433; 222/146.5

(58) Field of Search ..... 219/433, 429, 219/430, 432, 421, 385, 386; 222/146.5

(56) References Cited

U.S. PATENT DOCUMENTS

| | | | | | |
|---|---|---|---|---|---|
| 3,385,954 | A | * | 5/1968 | Rabinowitz et al. | 219/421 |
| 4,284,880 | A | * | 8/1981 | Keiser | 219/386 |
| 4,296,064 | A | * | 10/1981 | Satcher | 264/322 |
| 4,632,115 | A | * | 12/1986 | Bernardini | 607/86 |
| 4,696,303 | A | * | 9/1987 | Bernardini | 607/104 |
| 6,184,500 | B1 | * | 2/2001 | Glucksman | 219/432 |

* cited by examiner

*Primary Examiner*—Joseph Pelham
(74) *Attorney, Agent, or Firm*—Arthur M. Peslak, Esq.

(57) ABSTRACT

An arts and crafts hot pot is described. The arts and crafts hot pot is used to melt various types of materials such as thermographic resins, crayons, glue etc. The materials are used in the fabrications of various craft items.

2 Claims, 7 Drawing Sheets

ARTS AND CRAFTS HOT POT

BACKGROUND OF THE INVENTION

The present invention is directed to the field of arts of crafts. In particular, the present invention is directed to an apparatus that can be safely used to heat and melt substances known as thermographic resins or embossing powders. In particular, the present invention is directed to use with a very coarsely ground type of embossing powder referred to as Ultra Thick Embossing Powder or UTEE. The embossing powders, in the melted state, are used to coat various shaped items with the embossing powder to create various jewelry items and other molded artifacts. In addition, the present invention can also be utilized to melt other crafting materials such as candle wax, glue, crayons, soap, etc.

One of the currently available methods for melting embossing powders and other substances is to utilize a hair dryer to apply heat to a container in which the material to be melted is placed. There are also some crude integrated hot pot type devices. However, these prior methods suffer from various disadvantages. Among these disadvantages are a lack of control temperature selection and inconsistent application of heat. These disadvantages result in unreliable, mis-coloring (black) of the heated material which obscures the resulting color(s) of the heated material. The prior devices are also poorly shaped for accommodating the user, are non-ergonomic and not well balanced.

An object of the present invention is to provide an integrated hot pot that solves these problems with the presently available methods and devices. Thus, the present invention is directed to an ergonomically and stylishly designed hot pot that allows the user to achieve their goals and to safely use the hot pot for crafting applications.

SUMMARY OF THE INVENTION

The present invention comprises an arts and craft assembly for melting crafting materials comprising a non-heat conducting two piece tray—a top comprising an upper surface and a lower surface or base with a plurality of stabilizing legs provided thereon; a heating pan adapted to be received in and sandwiched between the upper surface and lower surface of the tray and comprising a source for generating heat to melt the crafting material; and a heating conducting vessel into which the crafting material to be melted will be placed that is adapted to be placed in thermal contact with the heating pan in the base.

DETAILED DESCRIPTION OF THE INVENTION

The present invention will now be described by means of a presently contemplated embodiment thereof. However, the scope of the present invention should not be limited by the embodiment described herein.

Figure 1:
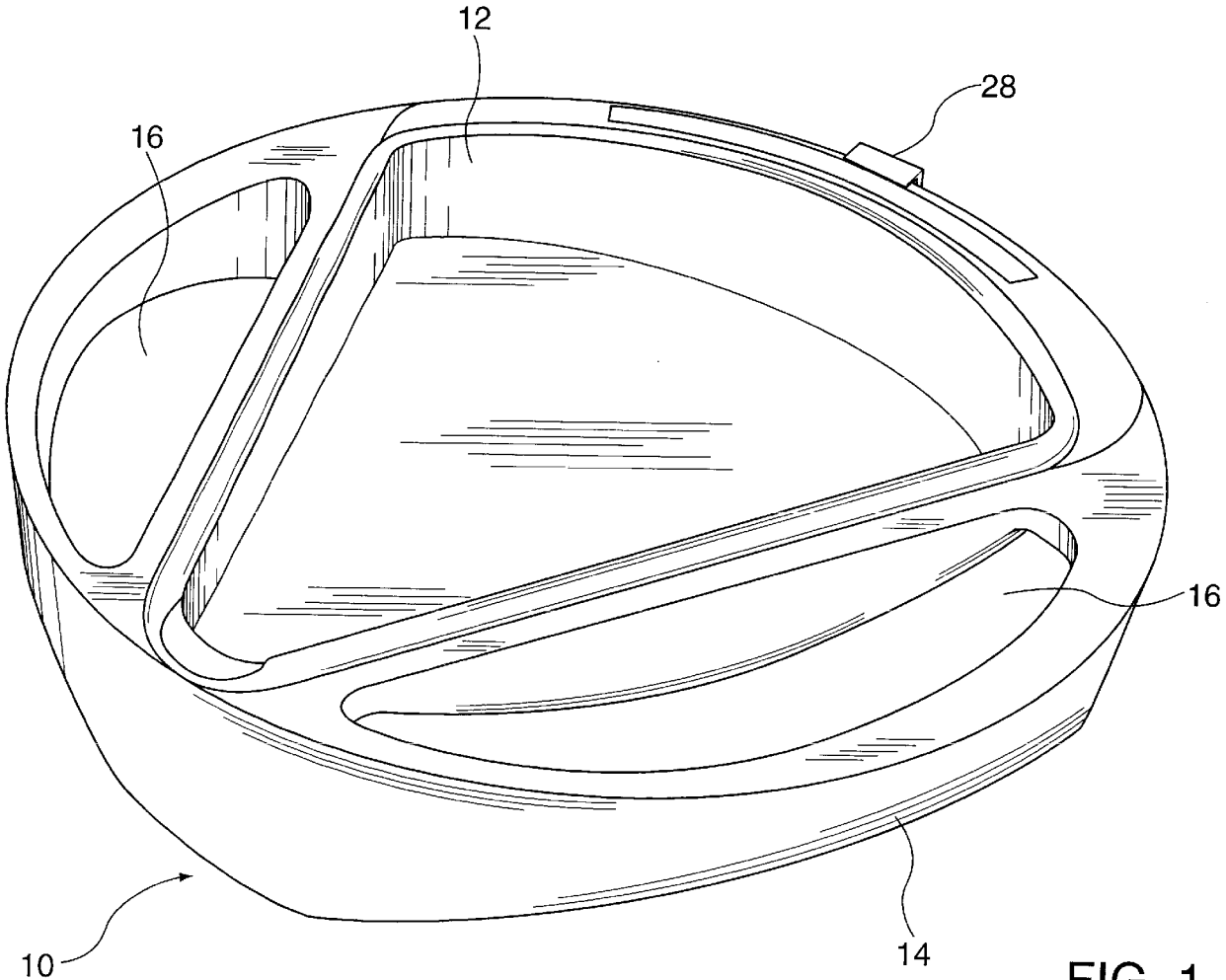
FIG. 1 is a perspective view of the assembly of the present invention.
Figure 2:
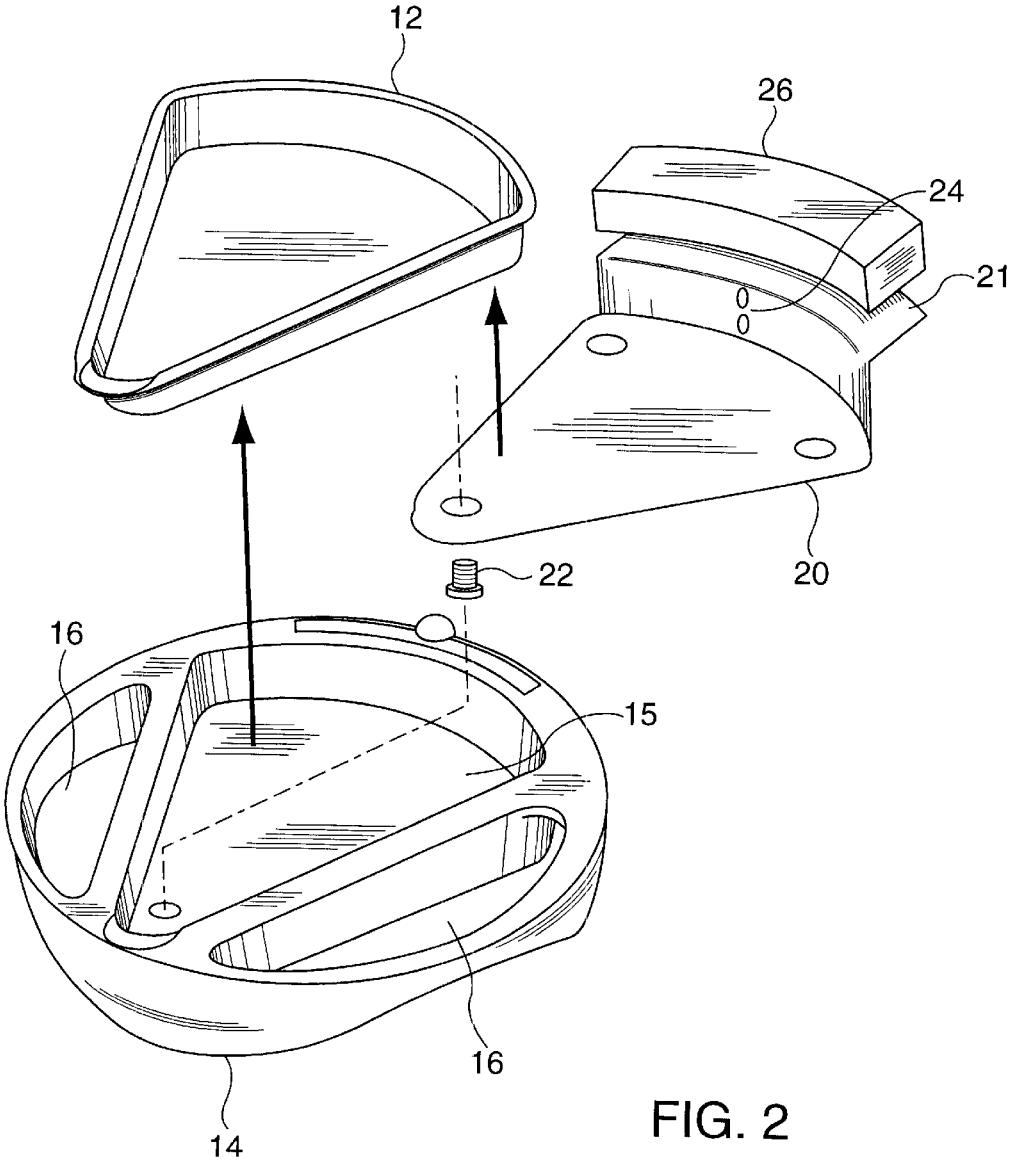
FIG. 2 is an exploded perspective view illustrating the components of the assembly of the present invention.

FIG. 1 illustrates an over all perspective view of a hot pot assembly 10 according to the present invention. FIG. 2 illustrates an exploded view of the parts comprising the hot pot assembly 10.

The hot pot assembly 10 comprises a generally pie-shaped bowl 12. It is presently contemplated that the pie shaped bowl 12 will be fabricated from heat conducting metal and will be coated with a non-stick material such as Teflon®. The bowl 12 is presently contemplated to be a replaceable item of the hot pot assembly 10.

The hot pot assembly 10 further comprises an ergonomically designed non-heat conducting base 14. The base 14 comprises a generally pie-shaped opening 15 that is generally adapted to receive the bowl 12. The base 14 as shown in this embodiment is fabricated of one-piece construction but it is contemplated that the base 14 could also be fabricated from two separate pieces that would snap together to facilitate repair or replacement of component parts. The perimeter of the base 14 also comprises two openings 16 that, with the rail, function as (finger) grips for the user and three formed legs 18 that function to stabilize the hot pot assembly 10.

The hot pot assembly 10 further comprises a pie-shaped heating pan assembly 20. As shown in FIG. 2, the heating pan assembly 20 will be first received in opening 15 and will be attached to base 14 by a plurality of fastening devices such as machine screws 22. The heating pan assembly 20 comprises an electrical connection 24 for connection to an AC power source. In the embodiment illustrated in FIG. 2, the electrical connection 24 is adapted to receive a removable power cord 25. However, those of ordinary skill in the art will recognize that a non-removable power cord could be hard wired into the heating pan without departing from the spirit or scope of the present invention. When an AC power source is electrically connected to the heating pan assembly 20, the surface temperature of the heating pan 24 will be raised. The heating pan assembly 20 further comprises an electronic heating control and read out assembly 26. The assembly 26 will be received on the upper lip 21 of the heating pan assembly 20 and fastened thereto. As illustrated in FIG. 1, a sliding switch 28 is disposed on top of the hot pot assembly 10 that allows the user to select specific temperatures and, therefore, to reliably control the temperature of the hot pot. Through this reliable temperature control, miscoloring of the heated material will be minimized.

After the heating assembly 20 is received in base 14, the removable and replaceable bowl 12 is received in the hot pot assembly 10 on top of the heating pan assembly 20. The bowl 12 is removable and not permanently fastened to the hot pot assembly 10. However, the bowl 12 is in thermal contact with the heating pan assembly 20. Therefore, when the heating pan assembly 20 is connected to the AC power source and its surface temperature raised as described above, the surface temperature of bowl 12 will be raised accordingly.

During use, the crafting material to be melted would be placed inside the bowl 12. The crafting material could be UTEE, regular embossing powder, candle wax, glue, crayons, soap, etc. The AC power source would be connected to the heating pan assembly 20 as described above. The user would set the appropriate heating temperature by means of the sliding switch 28. The surface temperature of the heating pan 24 will be raised in response to the connection to the AC power source and in turn the surface temperature of the bowl 12 will be raised. As the surface temperature of the bowl 12 reaches the melting point of the material placed therein, the material will become molten and ready for use.

Figure 3:
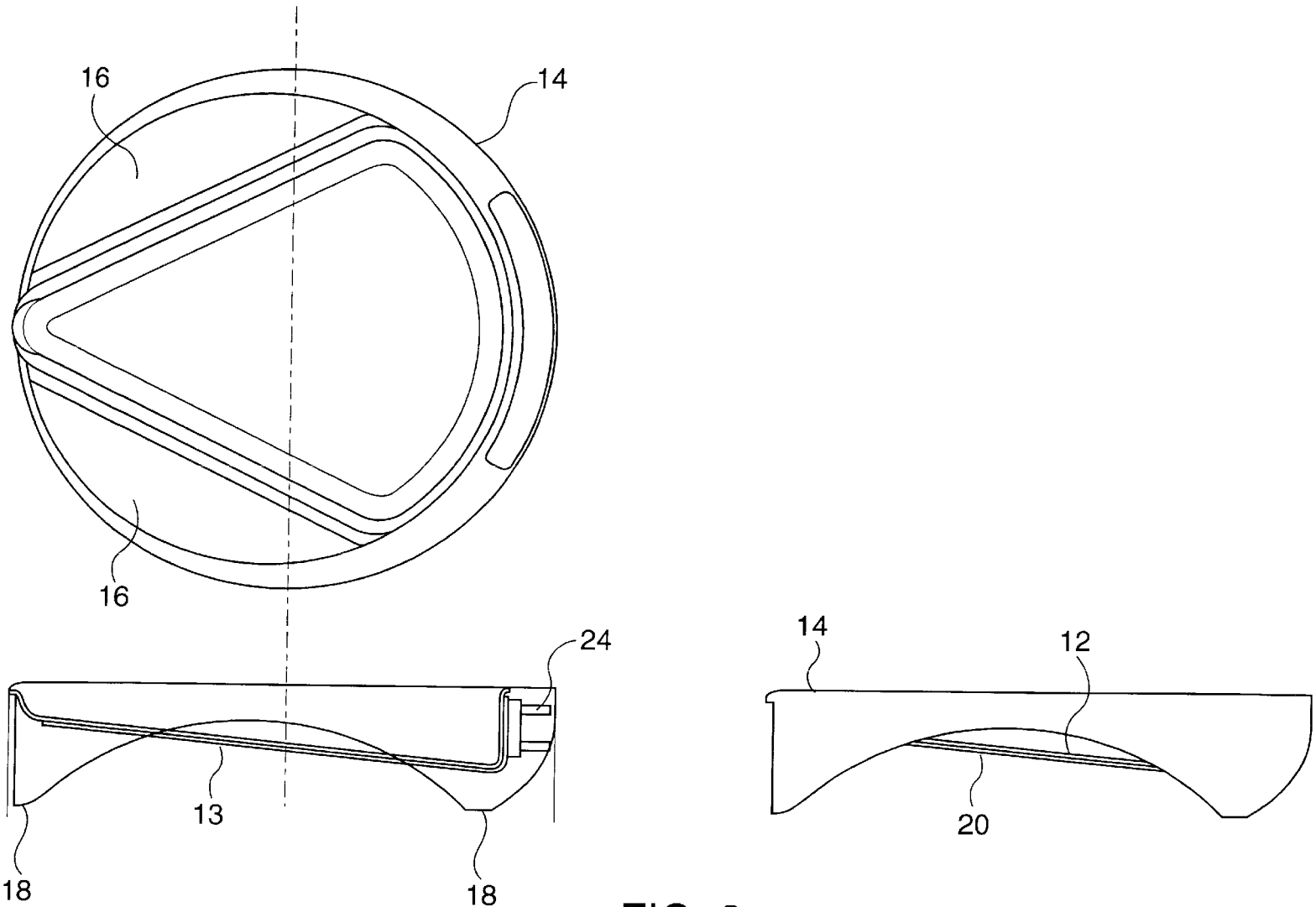
FIG. 3 is a side view of the assembly of the present invention.
Figure 4:
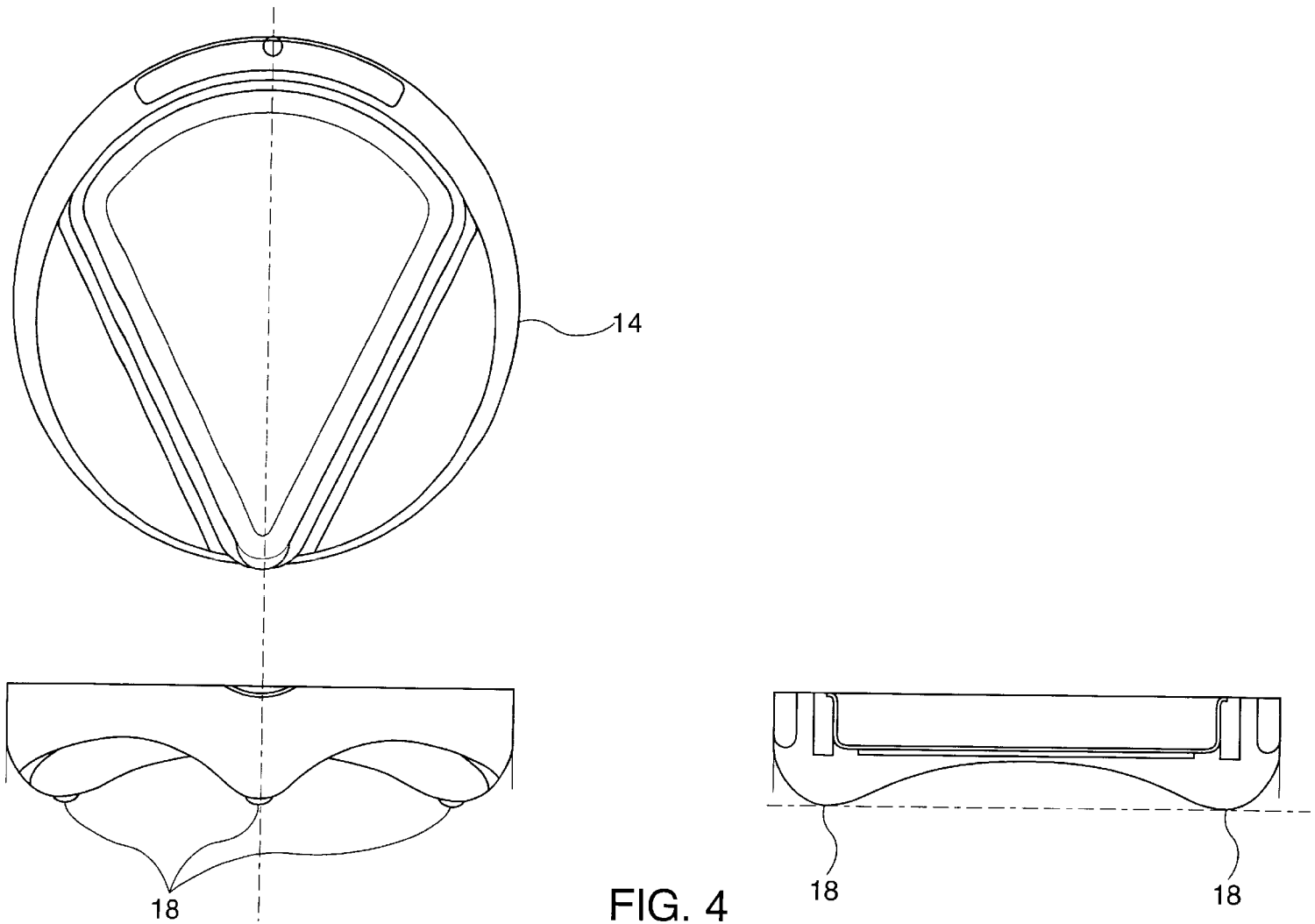
FIG. 4 is a front view of the assembly of the present invention.
Figure 5:
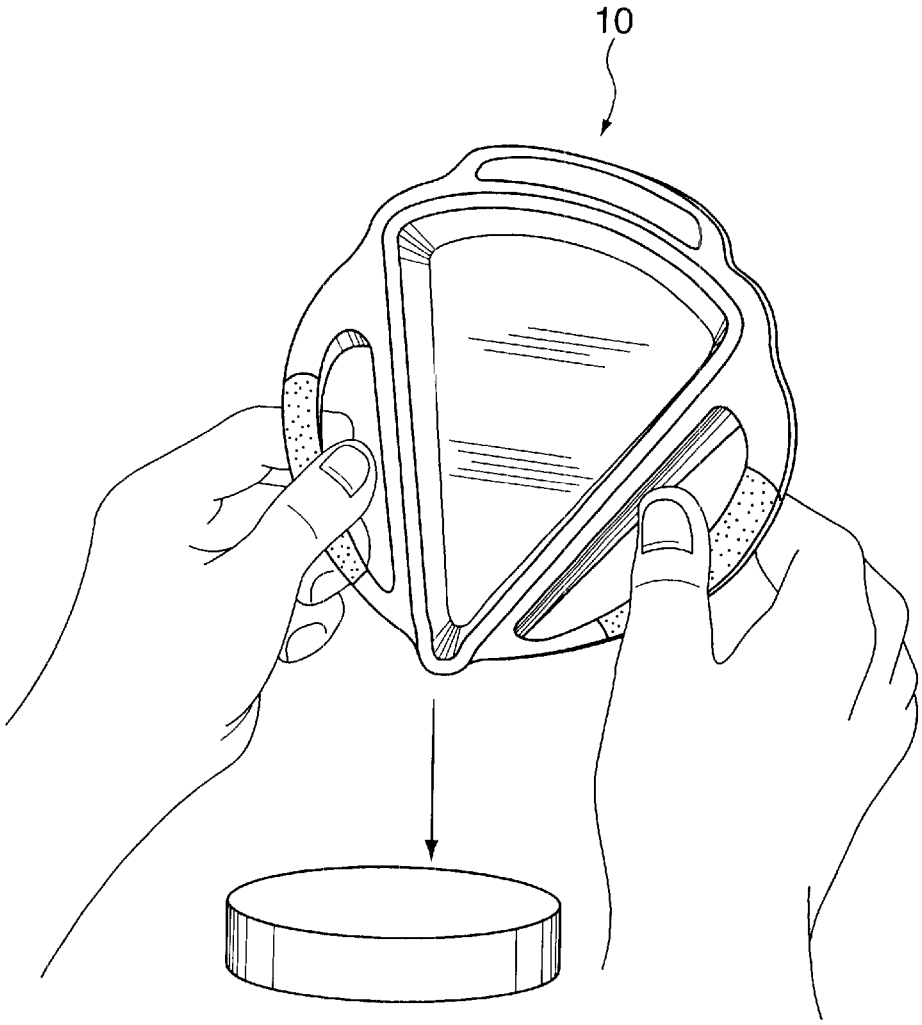
FIG. 5 is an illustration of a use of the assembly of the present invention.
Figure 6:
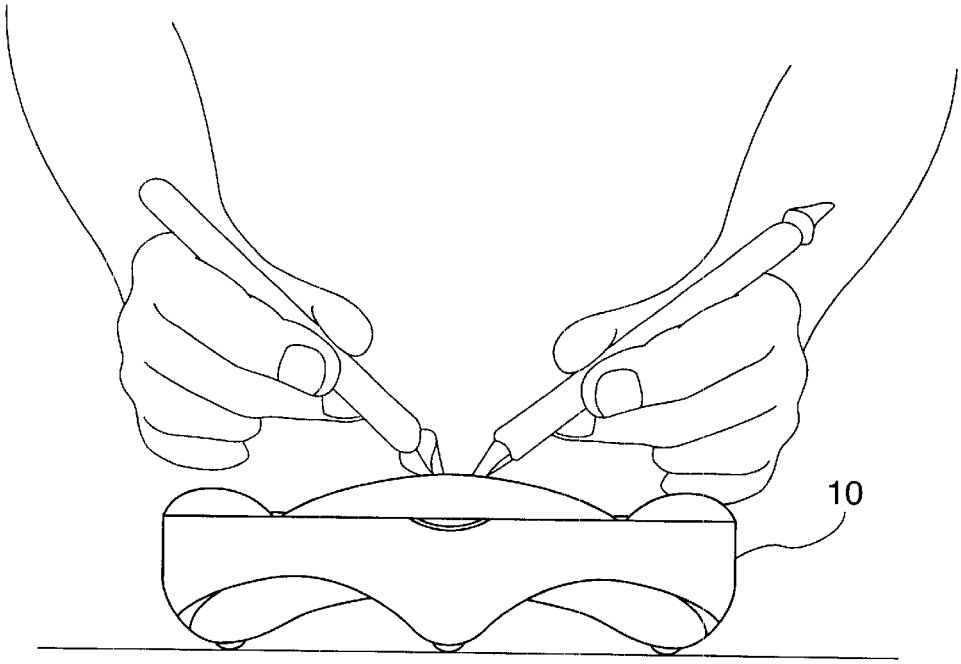
FIG. 6 is an illustration of a use of the present invention.
Figure 7:
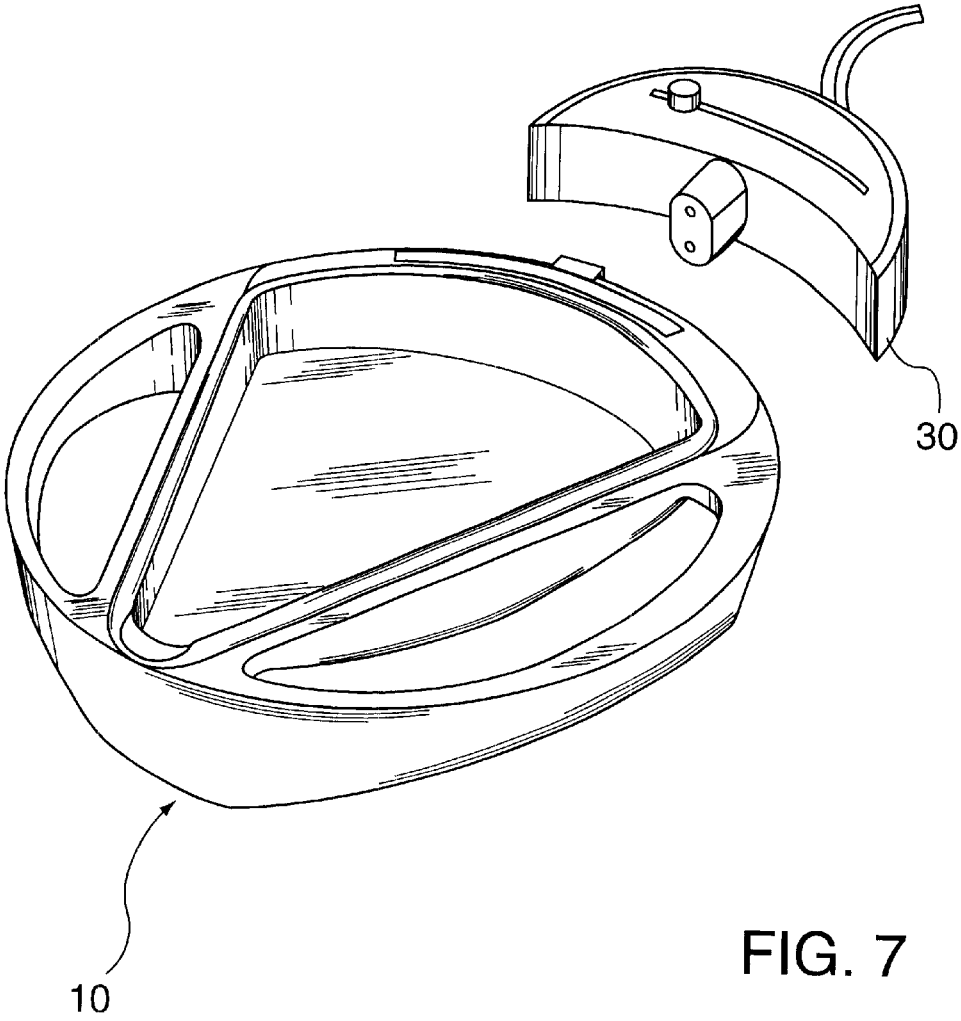
FIG. 7 is an exploded perspective view.

The use of the hot pot assembly 10 is illustrated by reference to FIGS. 5 and 6. As noted above, the base 14 is fabricated from non-heat conducting material. Therefore, even when the hot plate and bowl 12 become hot, the base will not be hot to the touch. If the user is operating directly out of the bowl 12 as shown in FIG. 6 by dipping craft items in the molten material, the user can achieve enhanced finger dexterity by comfortably resting his or hands on the raised areas of the perimeter ring of the base and not be burned due to the elevated temperature required to melt the material. If the user wants to pour the molten crafting material into another vessel such as a mold for creating certain shaped items, the base 14 facilitates that as well as shown in FIG. 5. Since the base 14 will not be hot to the touch, the user can grip the base 14 through the openings 15. The intended finger grip locations are marked for both visual and physical identification offering a point that is properly balanced. The pie shape of the bowl 12 and the position and shape of the spout on the narrow end of the bowl 12 facilitates safe pouring of the molten crafting material. As shown, with or without the control module in FIG. 5, the user picks up the entire hot pot assembly 10 by means of the handles 15 and then pours the material from the narrow end of the bowl 12. As shown in FIG. 3, the heating pan's lowest heat surface 13 is positioned at an angle to the horizontal. It is lower toward the rear and higher toward the front narrow end of the bowl 12 to provide greater control for pouring.

Those of ordinary skill in the art will recognize that the embodiments just described merely illustrate the principles of the present invention. Many modifications may be made thereto without departing from the spirit and scope of the invention as set forth in the following claims.

What is claimed is:

1. An arts and craft assembly for melting crafting materials comprising:

a) a non-heat conducting base comprising a plurality of openings to be used as handels, an upper surface and a lower surface with a plurality of stabilizing legs provide thereon;

b) a heating pan adapted to be received in the upper surface of the base and comprising a source for generating heat to melt the crafting material; and c) a generally pie-shaped heating conducting vessel into which the crafting material to be melted will be placed that is adapted to be placed in thermal contact with the heating pan in the base wherein the pie shape of the heat conducting vessel facilitates safe pouring of the crafting material upon melting by the user.

2. The Assembly of claim 1 wherein the source for generating heat is an AC electrical power input that raises the surface temperature of the heating pan.

* * * * *